United States Patent [19]

Brons

[11] 4,361,780

[45] Nov. 30, 1982

[54] HALOGEN INCANDESCENT LAMP

[75] Inventor: Hermanus Brons, Eindhoven, Netherlands

[73] Assignee: U.S. Philips Corporation, New York, N.Y.

[21] Appl. No.: 156,544

[22] Filed: Jun. 5, 1980

[30] Foreign Application Priority Data

Jun. 29, 1979 [NL] Netherlands ..... 7905058

[51] Int. Cl.[3] ..... H01K 1/56

[52] U.S. Cl. ..... 313/222; 313/178

[58] Field of Search ..... 313/222, 178

[56] References Cited

U.S. PATENT DOCUMENTS

| | | | |
|---|---|---|---|
| 2,444,423 | 7/1948 | Braunsdorff | 313/178 |
| 3,748,519 | 7/1973 | Martin et al. | 313/222 X |
| 3,829,729 | 8/1974 | Westlund, Jr. et al. | 313/222 X |
| 3,829,731 | 8/1974 | T'Jampens et al. | 313/222 X |
| 3,849,687 | 11/1974 | Huston et al. | 313/222 X |
| 4,096,405 | 6/1978 | Goto | 313/222 X |
| 4,128,783 | 12/1978 | Giller et al. | 313/222 X |

*Primary Examiner*—Palmer C. Demeo
*Attorney, Agent, or Firm*—Robert S. Smith

[57] ABSTRACT

In halogen incandescent lamps with bromine as the halogen and having a tantalum getter to absorb any free oxygen, the getter also absorbs bromine at high operating temperatures and affects the tungsten-bromine cycle adversely.

Tantalum alloyed with tungsten in a weight ratio range of 9/1 to 1/9 has a very much larger affinity to oxygen than it has to bromine. As a result of this the alloys are excellently suitable for use as an oxygen getter in tungsten/bromine cycle lamps.

1 Claim, 3 Drawing Figures

HALOGEN INCANDESCENT LAMP

Figure 1:
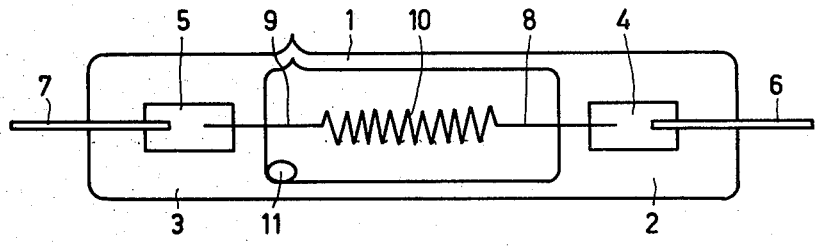

The invention relates to a halogen incandescent lamp having a light-pervious, vacuum-tight sealed lamp envelope which is filled with an inert gas containing hydrogen bromide, in which lamp a tungsten filament is accommodated between current supply conductors which pass through the wall of the lamp envelope. Tantalum is present in the envelope as an oxygen getter.

Such a lamp is known from U.S. Pat. No. 3,829,729. According to that patent, tantalum getters both oxygen and hydrogen. When the getter is accommodated in a place which, during operation, has a temperature of 300°–450° C., the gettering effect is said to be negligible for bromine.

Since the bromine in a halogen lamp comprising bromine has an essential function, it is important to prevent the getter from withdrawing bromine from the gas mixture. Therefore the indicated operating temperature of the getter should be strictly observed. However, in numerous lamps it is hardly possible to accommodate the getter at such a low temperature.

According to the said United States Patent, tantalum also getters hydrogen at the indicated comparatively low temperature. Hydrogen is also an essential gas component in a tungsten-bromine-cycle lamp. Bromine is an agressive material which transports tungsten from a place of lower temperature to a place of higher temperature. Thus this transport takes place from comparatively cold parts of a filament, for example the limbs or end forms of the filament, to parts at a higher temperature, i.e. turns remote from the ends. This transport leads inter alia to the formation of whiskers on the turns on which tungsten is deposited, and hence to shortcircuiting of turns and overload of the filament. As a result of this, the life of lamps having a comparatively long calculated life, for example from a few hundred to two thousand hours, is considerably reduced.

The function of hydrogen in a tungsten-bromine cycle lamp is to keep the bromine, during operation of the lamp, preponderantly in the form of hydrogen bromide, notably in places of lower temperature. Colder tungsten parts of the lamp experience protection thereby against attack by bromine.

Oxygen is a detrimental component of the gas of a tungsten bromine cycle lamp in which hydrogen occurs. Oxygen can form water with the hydrogen which in a cyclic process transports tungsten from a high to a low temperature place and hence acts oppositely to the tungsten-bromine cycle. In addition, oxygen withdraws hydrogen, by binding it, from its protective function. Oxygen may occur in the gas of the lamp as a result of decomposition of oxides or as water after desorption from the wall of the lamp envelope.

The capacity of a getter should be sufficiently large to getter the oxygen which is released during the life of a lamp. The capacity should therefore be larger than is necessary to getter the quantity of oxygen which initially is present as a result of an incomplete cleaning process during the manufacture of a lamp. On the other hand the capacity of the getter should be sufficiently small that it does not detrimentally getter hydrogen and bromine, substances which are present in the lamp to a much greater extent than oxygen, and can hence easily saturate the getter. The affinity of tantalum for oxygen, bromine and hydrogen is in fact very little different.

It is the object of the invention to provide a halogen incandescent lamp having a getter for oxygen, in the element form or in the form of water, which considerably more selectively getters oxygen and which is operative over a very wide temperature range.

According to the invention, this object is achieved in lamps of the kind defined in the opening paragraph in that the oxygen getter consists of tantalum which is alloyed with tungsten in a weight ratio range of 1/9 to 9/1.

It is to be noted that a halogen lamp with hydrogen bromide is disclosed in United Kingdom Patent Application No. 7943091, in which inter alia an alloy of tantalum with platinum or tantalum with palladium is used as an oxygen getter. These tantalum alloys and the other alloy mentioned in the said United Kingdom Patent Application have a great negative heat of formation (approximately 80 kJ/g.at). Consequently, oxygen can, and hydrogen bromide can no longer, react with the tantalum in the alloy.

In contrast therewith, tungsten/tantalum alloys have a very small negative heat of formation (approximately 10 kJ/g.at), so that a selective reaction of the alloy with gases may not be expected from said small heat of formation. Nevertheless, not only has a very large selectivity of the getter in the lamp according to the invention been established, but the getter also has a larger reactivity for oxygen than pure tantalum. This increase is more than 30%. On the other hand, the reactivity of the alloy for bromine or hydrogen bromide proved to be only 0,25 to 0,05 of that of pure tantalum, while no indication whatsoever was obtained that hydrogen is withdrawn by the getter from the gas mixture of the lamp.

U.S. Pat. No. 3,748,519 discloses a lamp which is filled with an inert gas and in which an oxygen getter is used which consists of 92.5% by weight of tantalum and 7.5% by weight of tungsten. Since no gas components occur in said lamp for which tantalum has the same affinity as for oxygen, a selectively acting getter is not required in the known lamp. So it can by no means be inferred from said Patent that the getter used would have a selective activity. The known getter moreover has a significantly smaller selectivity than the getters which are used in the bromine tungsten cycle lamp according to the invention.

The alloyed tantalum tungsten getter can exert its action over a very wide temperature range. As a rule the getter during operation of the lamp has a temperature between 300° and 1500° C. In cases where the temperature of the getter is higher than approximately 700° C., the lamp comprises as an inert gas a rare gas or a mixture of rare gasses. At temperatures lower than approximately 700° C., nitrogen is also an inert gas.

The alloyed tantalum/tungsten getter may be present in the lamp as a wire, a foil, a powder, a pellet or in any other convenient form. With a view to the selectivity of the getter it should only be ensured that the capacity of the getter is sufficient to prevent detrimental effects as a result of the release of oxygen from components of the lamp. The minimum required quantity of getter can easily be determined for any type of lamp by a small series of tests, this quantity also taking into account the quality of the cleaning processes of the lamp concerned and the components used.

The getter may be manufactured in various ways. For example, the components of the alloy may be mixed in powder form and the powder compressed, sintered, and then melted, for example in a discharge arc. Another possibility is to cover a substrate of one of the two components with a layer of the other component, for example, by vapor deposition, sputtering, or chemical vapor deposition, and to cause the metals of the layers to diffuse into each other at elevated temperature.

Another possibility is to wind a wire of tantalum around a wire of tungsten and to cause the metals to subsequently diffuse into each other.

Diffusion processes may be continued until a homogeneous material is obtained, or may be discontinued earlier so that there is a concentration gradient of one metal in the other metal.

The getter is very stable in air at room temperature so that no special measures need normally be taken during its processing. Dependent on the circumstances in which the getter is manufactured, however, the getter may already be partly covered with an oxide and/or a nitride skin. A pretreatment at elevated temperature, for example 1100° C., for, for example, 2 minutes in a reducing atmosphere, for example hydrogen, easily cleans the getter.

The lamps according to the invention may be constructed with a hard glass lamp envelope, for example, of borosilicate glass or aluminium-borosilicate glass, or with a lamp envelope having an $SiO_2$ content of at least 95% by weight, for example quartz glass. The lamps may be floodlight lamps or lamps destined for other various purposes, for example for projection, copying, and traffic purposes.

Embodiment of lamps according to the invention are shown in the accompanying drawing. In the drawing FIG. 1 is an elevation of a first lamp according to the invention, FIG. 2 is an elevation of a second lamp according to the invention, and FIG. 3 shows a graphical representation of the properties of the getters which are used in lamps according to the invention, compared with related materials.

The lamp shown in FIG. 1 has a quartz glass lamp envelope 1 having two pinch seals 2 and 3 in each of which is embedded a respective molybdenum foil 4 and 5. Limbs 8 and 9, of filament 10 are respectively welded to one end of the foils 4 and 5 and external current conductors 6 and 7 are respectively welded to the other end of the foils. The lamp envelope is filled with a mixture of one or more rare gasses and hydrogen bromide. 11 denotes a hydrogen bromide-resistant oxygen getter consisting of tantalum alloyed with tungsten in a weight ratio in the range of 1/9 to 9/1. The lamp may be used, for example, as an automobile lamp.

Figure 2:
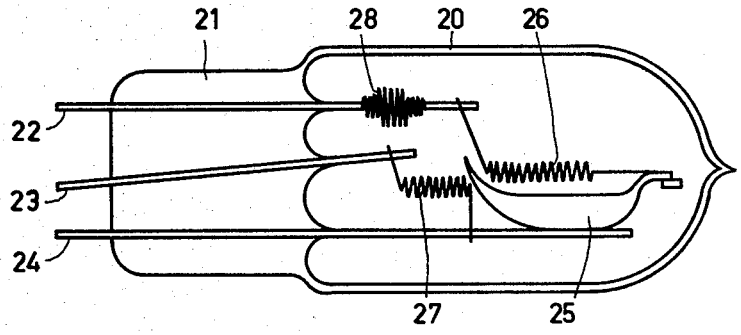

Reference numeral 20 in FIG. 2 denotes the hard glass lamp envelope of a lamp having a pinch seal 21. The lamp envelope consists of alkali alumino-borosilicate glass. Current supply conductors 22, 23 and 24 extend through the pinch seal 21 in a vacuum-tight manner into the lamp envelope 20. A molybdenum disk 25 is secured to the current supply conductor 24 and partly surrounds the filament 26. A second filament 27 is accommodated between the current supply conductors 23 and 24. A wire 28 is wound around current supply conductor 24 and encloses an oxygen getter consisting of tantalum alloyed with tungsten in a weight ratio in the range 1/9 to 9/1, in powder form between the current supply conductor 22 and the wire 28. The lamp may be used as an automobile lamp having a main beam and a dipped beam light.

Figure 3:
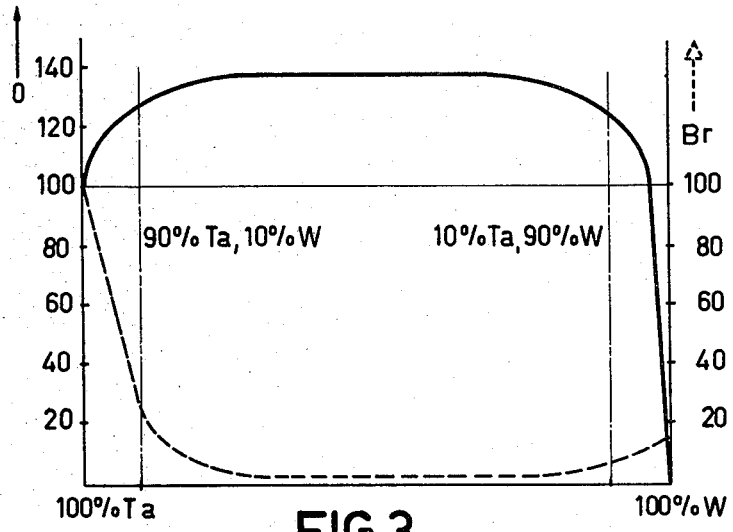

The solid line in FIG. 3 denotes the relative reactivity at 360° C. of tantalum, of tungsten and of tantalum/-tungsten alloys with oxygen. The reactivity of tantalum with oxygen is arbitrarily assumed to be 100. The broken line is the reactivity of the said materials with bromine, the reactivity of tantalum with bromine again being assumed to be 100. As can be seen, the difference between the reactivity of the getter with oxygen and with bromine is greatest in the region between the chain-dotlines, i.e. in a weight ratio in the range 1/9 to 9/1.

Lamps as shown in FIG. 1 were used for experiments in which the effect of the alloyed tantalum/tungsten getter was established. The lamps had a volume of 0.27 $cm^3$ and were filled to a pressure of 3.5 bars with a mixture of krypton and methylene bromide (100:0.35 vol/vol), from which hydrogen bromide was formed upon ignition of the lamps. The lamps had an efficiency of 26 lm/W and at 13.2 V consumed a power of 60 Watt. During the manufacture of the lamps it was endeavoured, inter alia by a carefully performed pumping process, to obtain clean lamps with a life corresponding to the computed life.

The high quality of most of the lamps was destroyed by the addition of oxygen to the filling gas. A quantity of gettering material was added to most of such lamps. All lamps were tested for life. The various lamps with their lives are recorded in Table 1. In this and the subsequent Tables, lamps in the "A" series were not in accordance with the invention and lamps in the "B" series were in accordance with the invention.

TABLE 1

| Series | Oxygen | getter | life (hrs) |
|---|---|---|---|
| $A_1$ | none | none | 601 |
| $A_2$ | 267 Pa | none | 270 |
| $A_3$ | 267 Pa | Ta 1.75 mg | 370 |
| $B_1$ | 267 Pa | $Ta_{90}W_{10}$ 1.16 mg | 500 |
| $B_2$ | 267 Pa | $Ta_{75}W_{25}$ 3.34 mg | 520 |
| $B_3$ | 267 Pa | $Ta_{50}W_{50}$ 1.50 mg | 520 |
| $B_4$ | 267 Pa | $Ta_{25}W_{75}$ 1.70 mg | 550 |
| $B_5$ | 267 Pa | $Ta_{14}W_{86}$ 0.50 mg | 480 |

From Table 1 it can be seen that the life of a carefully manufactured lamp ($A_1$), which is approximately equal to the computed life, is reduced considerably by the presence of oxygen ($A_2$). Tantalum as a getter is capable of only partly preventing this reduction ($A_3$). By using tantalum/tungsten alloys of different weight ratios in the range 1/9 to 9/1—the subscript index figures denoting the weight ratios of the alloyed metals—the reduction in life as a result of the presence of oxygen is very considerably reduced ($B_1$–$B_4$). It also appears that the quantity of gettering material is of little influence.

The lamps $B_5$ were provided with a getter which had been obtained by causing a 25 μm thick layer of tantalum to diffuse in a tungsten wire of 100 μm diameter for 3 hours at 2500° C. A tantalum concentration in the tungsten which decreased from the outside to the inside of the wire was thereby obtained.

Lamps of the same kind were also provided with gettering material which had previously been reduced in hydrogen at 1100° C. for 2 minutes. The results of life tests are recorded in Table 2, the series of lamps $A_1$ to $A_3$ of Table I again being given for comparison.

TABLE 2

| Series | Oxygen | getter | life (hrs) |
|---|---|---|---|
| $A_1$ | none | none | 601 |
| $A_2$ | 267 Pa | none | 270 |
| $A_3$ | 267 Pa | Ta 1.75 mg | 370 |

TABLE 2-continued

| Series | Oxygen | getter | life (hrs) |
|---|---|---|---|
| $B_6$ | 267 Pa | $Ta_{50}W_{50}$ 3 mg | 590 |
| $B_7$ | 267 Pa | $Ta_{90}W_{10}$ 3 mg | 619 |

From Table 2 it can be seen that the cleaned alloyed getters entirely remove the detrimental effect of oxygen ($B_6$ and $B_7$). It is to be noted that the getters after the treatment with hydrogen were stored in air at room temperature prior to being assembled in the lamps.

Comparable lamps provided with a filament which consumed 50 W with an efficiency of 18 lm/W at 12 V were filled with 5 bars of a mixture of krypton and methylene bromide (100:0.05 vol/vol). The lamps were tested for life with and without a getter and with and without oxygen. The results are recorded in Table 3.

TABLE 3

| Series | Oxygen | getter | life (hrs) |
|---|---|---|---|
| $A_4$ | none | none | 5500 |
| $A_5$ | 70 Pa | none | 1700 |
| $A_6$ | 70 Pa | Ta 0,4 mg | 5600 |
| $B_8$ | 70 Pa | $Ta_{10}W_{90}$ mg | 5000 |

From the data in Table 3 it should not be derived that tantalum by itself ($A_6$) nullifies the adverse effect of the oxygen. The lamps denoted by $A_6$ were in fact considerably blackened, which indicates that the bromine-tungsten cycle functioned insufficiently. The strong blackening indicates a reduction in diameter of the filament and associated resistance increase and reduction of current intensity. The resulting decrease in temperature explains the long life of the lamps. In this connection it is to be noted that the efficiency stated of the lamps is only the efficiency at the beginning of the life in the case of the blackened lamps $A_6$.

The lamps $B_8$ remained bright with the tantalum-tungsten alloy. The effect of oxygen was substantially nullified by the getter.

What is claimed is:

1. A halogen incandescent lamp having a light-pervious, vacuum-tight sealed lamp envelope which is filled with an inert gas containing hydrogen bromide, in which lamp a tungsten filament is accommodated between current supply conductors which pass through the wall of the lamp envelope and in which envelope tantalum is present as an oxygen getter, characterized in that the oxygen getter consists of tantalum which is alloyed with tungsten in a weight ratio in the range 1/9 to 9/1.

* * * * *